US005088291A

United States Patent [19]

Squires

[11] Patent Number: 5,088,291

[45] Date of Patent: Feb. 18, 1992

[54] APPARATUS FOR PASSIVE REFRIGERANT RETRIEVAL AND STORAGE

[75] Inventor: David C. Squires, Port Huron, Mich.

[73] Assignee: Squires Enterprises, Port Huron, Mich.

[21] Appl. No.: 643,527

[22] Filed: Jan. 18, 1991

Related U.S. Application Data

[63] Continuation-in-part of Ser. No. 593,689, Oct. 10, 1990.

[51] Int. Cl.[5] ..... F25B 45/00

[52] U.S. Cl. ..... 62/77; 62/292; 62/149

[58] Field of Search ..... 62/77, 85, 149, 474, 62/475, 292

[56] References Cited

U.S. PATENT DOCUMENTS

| | | | |
|---|---|---|---|
| 3,232,070 | 2/1966 | Sparano | 162/77 |
| 4,285,206 | 8/1981 | Koser | 62/292 |
| 4,363,222 | 12/1982 | Cain | 62/126 |
| 4,364,236 | 12/1982 | Lower et al. | 62/292 |
| 4,441,330 | 4/1984 | Lower et al. | 62/149 |
| 4,476,688 | 10/1984 | Goddard | 62/149 |
| 4,480,446 | 11/1984 | Margulefsky et al. | 62/474 |
| 4,539,817 | 9/1985 | Staggs et al. | 62/149 |
| 4,646,527 | 3/1987 | Taylor | 62/85 |
| 4,766,733 | 8/1988 | Scuderi | 62/85 |
| 4,768,347 | 9/1988 | Manz et al. | 62/149 |
| 4,809,520 | 3/1989 | Manz et al. | 62/292 |
| 4,856,289 | 8/1989 | Lofland | 62/149 |
| 4,903,499 | 2/1990 | Merritt | 62/149 |
| 4,909,042 | 3/1990 | Proctor et al. | 62/149 |
| 4,934,390 | 6/1990 | Sapp | 62/77 |
| 4,939,903 | 7/1990 | Goddard | 62/77 |
| 4,967,570 | 11/1990 | Van Steenburgh, Jr. | 62/77 |

FOREIGN PATENT DOCUMENTS

| | | |
|---|---|---|
| 193567 | 8/1989 | Japan . |
| 225874 | 9/1989 | Japan . |
| 251597 | 10/1970 | U.S.S.R. . |
| WO81/00756 | 3/1981 | World Int. Prop. O. . |
| WO89/03963 | 5/1989 | World Int. Prop. O. . |

*Primary Examiner*—Henry A. Bennett
*Assistant Examiner*—John Sollecito
*Attorney, Agent, or Firm*—Harness, Dickey & Pierce

[57] ABSTRACT

A passive refrigerant retrieval and storage apparatus is shown for retrieving refrigerant from a cooling system prior to servicing the cooling system. The passive apparatus includes a coil collector tube within an insulated housing with an outlet from the collector tube passing through a metering valve into the housing. The collector tube is connected to the condenser outlet of a cooling system and the system compressor operated to pump pressurized liquid refrigerant into the collector tube. A small portion of the refrigerant is discharged through the metering valve into the apparatus housing where it is evaporated and causes extreme subcooling to the refrigerant in the collector tube. A return line from the housing to the inlet side of the compressor returns the evaporated refrigerant to the cooling system. Gradually the cooling system is starved for refrigerant such that the pressures in both the high pressure side and low pressure side of the cooling system gradually decrease, decreasing the pressure of refrigerant within the collector tube and housing of the retrieval apparatus such that the liquid will no longer evaporate, trapping the refrigerant in the retrieval apparatus.

17 Claims, 3 Drawing Sheets

APPARATUS FOR PASSIVE REFRIGERANT RETRIEVAL AND STORAGE

CROSS REFERENCE TO RELATED APPLICATION

This application is a continuation-in-part of application Ser. No. 07/593,689, filed Oct. 10, 1990.

BACKGROUND AND SUMMARY OF THE INVENTION

The present invention relates to a method and apparatus for retrieving and storing a refrigerant while servicing a cooling or heat pump system and in particular to a passive retrieval and storage apparatus.

It is widely believed today that refrigerants, typically chlorofluorocarbons, used in vapor compression cooling and heat pump systems have a detrimental effect on the earths' atmospheric ozone layer when the refrigerant is released from the cooling system into the atmosphere. When repairing a cooling system, it is often necessary to first remove the refrigerant from the cooling system. The refrigerant can either be released to the atmosphere or it can be recovered for later use in the same equipment, or subsequent reprocessing and reuse. Because of the harmful effects associated with the release of refrigerant to the atmosphere, several devices have been developed in recent years to retrieve the refrigerant from a cooling system before it is serviced. Many of these devices, in addition to retrieving the refrigerant, also purify the refrigerant so that the refrigerant can be used to recharge the cooling system after the necessary repairs have been made.

Many of these refrigerant retrieval systems include several components typically found in cooling systems such as a compressor, condenser and evaporator. The compressor is generally used to draw the refrigerant from the cooling system into the retrieval system where it is condensed, purified and stored for later reuse and pumped back into the system being serviced. Such systems are relatively expensive and can also be difficult to transport to the job site when making a service call to repair a cooling system. For a service company having a fleet of service trucks, to equip each truck with such a recovery system can be very expensive and space consuming. The expense and transport of the recovery system may not be justified by the cost savings from reusing the refrigerant and may outweigh a desire to avoid environmental damage. As a result, many appliance repairmen may not bother to recover refrigerant from cooling systems.

Accordingly, it is an object of the present invention to provide a simplified apparatus for refrigerant retrieval that can be easily transported to the cooling system being repaired and which is less expensive than the large retrieval systems currently in use that include a compressor.

It is a feature of the retrieval and storage apparatus of the present invention to utilize the compressor of the cooling system being repaired in the retrieval process rather than including a compressor in the retrieval apparatus. The apparatus of this invention many also be employed in conjunction with an auxiliary compressor in conditions of failure of the serviced system compressor.

The apparatus of the present invention includes a coiled collector tube for receiving pressurized liquid refrigerant from the cooling system. The collector tube is contained within a well insulated evaporator housing. One end of the collector tube is connected to the high pressure side of the cooling system to receive pressurized liquid refrigerant from the condenser. The other end of the collector tube includes an adjustable metering valve leading to a refrigerant outlet that discharges refrigerant from the collector tube into the evaporator housing. The interior of the evaporator housing is connected to the low pressure side, or inlet side, of the compressor of the cooling system to draw the evaporated refrigerant into the compressor. The existing service ports on the cooling system can be the connection points.

In operation, the cooling system compressor is activated to pump condensed pressurized liquid refrigerant into both the system evaporator and the collector tube which is now functioning as a parallel evaporator. As the refrigerant passes through the metering valve into the evaporator housing, the refrigerant will flash causing the available heat to be removed within the evaporator housing. The temperature within the housing will decrease to a point where there is not enough available heat to evaporate all the liquid refrigerant entering the evaporator housing. At this point only a small portion of the refrigerant is now flashed since the only heat available is what is introduced into the evaporator housing by the sensible heat being given off from the collector tube. The warm liquid refrigerant within the collector tube is now undergoing extreme subcooling. Since the entering liquid refrigerant that does not evaporate has already been cooled to about the same temperature as the evaporator housing, it is relatively stable and will begin to collect in the bottom of the evaporator housing. It is now trapped there due to the limited heat available within its environment.

The evaporated refrigerant picks up heat from the collector tube, as it is pulled from the evaporator housing through the outlet back into the compressor where it is pressurized and later condensed and returned to the collector tube. As the cold liquid refrigerant is trapped in the collector tube, the system pressures generated by the compressor will gradually decrease as less refrigerant becomes available for the compressor to displace. When the quantity of refrigerant leaving the device equals the quantity of refrigerant entering the device, the exit is closed trapping the evaporated refrigerant in the housing. The compressor continues to run, forcing the refrigerant gas left in the system into the collector tube where much of it will condense because of the cold environment that has been created in the evaporator housing. When the internal temperature of the device has risen to where no more condensation is possible, the saturation temperature, the inlet valve of the retrieval apparatus is closed.

At this point, 85% to 95% of the refrigerant of the cooling system has been retrieved. Additional refrigerant can be retrieved by installing a piercing valve on the cooling system line leading from the compressor outlet and connecting the piercing valve directly to a port on the evaporator housing of the retrieval device. The cooling system line downstream from and immediately adjacent to the piercing valve is pinched-off so that all of the remaining refrigerant is pumped into the retrieval device. This refrigerant is discharged into the bottom of the housing whereby the refrigerant vapor must travel through the already collected liquid refrigerant and is thereby cooled and condensed. The system compressor will pull the system into a vacuum. The cooling system can now be repaired and since all the refrigerant has been retrieved, there is no release of refrigerant to the atmosphere.

Further objects, features and advantages of the invention will become apparent from a consideration of the following description and the appended claims when taken in connection with the accompanying drawings.

DETAILED DESCRIPTION OF THE INVENTION

Figure 1:
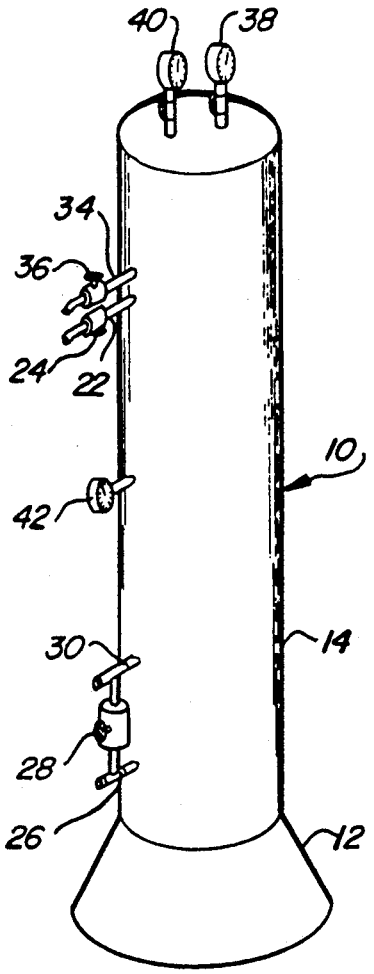
FIG. 1 is a perspective view of the passive refrigerant retrieval and storage apparatus of the present invention.
Figure 2:
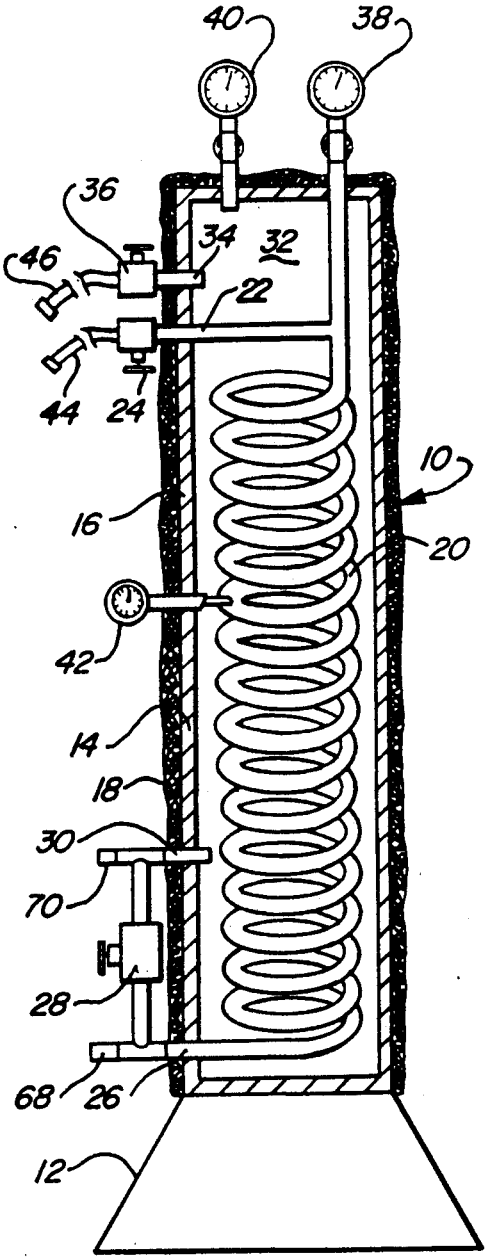
FIG. 2 is a elevational sectional view of the apparatus of FIG. 1 showing the interior components.

One embodiment of the refrigerant retrieval and storage apparatus of the present invention is shown in FIGS. 1 and 2 and designated generally at 10. Apparatus 10 includes a base 12 supporting a generally vertical housing 14. Housing 14 consists of a tube 16 surrounded by insulation 18.

Housing 14 contains a coiled collector tube 20 vertically oriented within the housing. The tube 20 has an inlet 22 which extends through the housing to an inlet valve 24 called the high side valve. The lower end of the collector tube passes through the housing 14, forming an outlet 26. Outlet 26 is connected to an adjustable metering valve 28 leading to a tube 30 that passes back through the wall of housing 14 to the housing interior 32. The housing 14 includes an outlet 34 with a low side valve 36 near the upper end of the housing.

A high side pressure gauge 38 is connected to the collector tube 20 to monitor the pressure within the tube while a low side pressure gauge 40 monitors the pressure within the interior 32 of housing 14. A thermometer 42 is coupled to collector tube 20 to monitor the coolant temperature therein. Flexible inlet hose 44 coupled to the high side valve 24 and flexible outlet hose 46 coupled to low side valve 36 are used to connect the apparatus 10 to the normal service access ports 62 and 64 of a cooling system such as the cooling system 48 shown in FIG. 3.

Cooling system 48 includes a compressor 50, condenser 52, metering device 54 and evaporator 56 connected to one another as shown by appropriate tubing 58 through which a refrigerant flows in the direction of arrow 60. Such cooling systems typically contain an access port 62 immediately following the condenser 52 as well as an access port 64 at the inlet side of the compressor 50.

Retrieval and storage apparatus 10 is coupled to the cooling system 48 to retrieve refrigerant therefrom prior to servicing the cooling system 48 by connecting the inlet hose 44 to access port 62 and the outlet hose 46 to the access port 64. Retrieval of refrigerant begins with the high side valve 24 and low side valve 26 open and the adjustable metering valve 28 closed. The compressor 50 of the cooling system is activated, compressing refrigerant gas which is then condensed in condenser 52. Since the internal pressure in collector tube 20 is initially low, a portion of the condensed pressurized refrigerant will flow through the access port 62 into the collector tube rather than flowing through the restricted flow metering device 54. As liquid refrigerant collects in tube 20, the metering valve 28 is slowly opened to allow a portion of the refrigerant to flow from the collector tube 20 into the relatively low pressure housing 14 interior where a small portion of liquid refrigerant flashes and is evaporated in the housing 14. As this refrigerant evaporates, the liquid refrigerant passing through collector tube 20 is cooled.

The evaporated refrigerant in housing 14 is drawn through the outlet 34 into the suction or inlet port 64 of the compressor 50. Initially, the pressure within the collector tube 20 approaches the normal high side operating pressure of the cooling system. However, as more and more refrigerant collects in the housing 14, the amount of evaporated refrigerant in the cooling system decreases such that the compressor outlet and inlet pressures begin to fall. As this occurs, the pressure in collector tube 20 also drops. In response to the gradually dropping pressure within tube 20, the adjustable metering valve 28 is gradually opened to allow more refrigerant to flow from the tube 20 into housing 14 where some of the refrigerant is evaporated. As the cooling system 48 is gradually starved for refrigerant, the pressures in the system gradually decrease as does the temperature of the refrigerant in the collector tube 20. Approximately 90% of the refrigerant will be contained within the housing 14 and collector tube 20 in liquid form. Retrieval of liquid refrigerant will stop when the charge in the cooling system is not sufficient for condensation to occur in the system. Additional refrigerant can be recovered by closing the low side valve 36. Refrigerant will continue to be recovered until no more vapor is condensed into collector tube 20 and housing 14. At this point 85–95% of the cooling system charge has been recovered and the high side valve 24 is closed, separating the apparatus 10 from the cooling system. Eventually all of the refrigerant will be contained within the housing 14 in liquid form.

The retrieval and storage apparatus is referred to as a passive apparatus in that it does not necessarily include its own compressor to draw refrigerant from the cooling system. Rather, it utilizes the stored energy in the refrigerant created by the cooling system compressor and an environment that traps the refrigerant outside of the cooling system 48. Only a small percentage of cooling system repairs involve the compressor such that in most instances, the cooling system compressor is available for use in retrieving the refrigerant. Alternatively, however, a separate compressor (not shown) could be used with apparatus 10 where the compressor 50 of the cooling system 48 being serviced is not functioning.

After disconnecting the retrieval apparatus 10 from the cooling system, the remaining coolant can be collected in a balloon or like device or discharged to the atmosphere. The apparatus 10 is a relatively simple structure not including a compressor or other mechanical devices as commonly found in the active refrigerant retrieval systems currently available. As a result, the retrieval apparatus 10 is significantly lower in cost. The lower costs will make it more economical for many repairmen to use such that more refrigerant will be retrieved as compared to current practice.

Once the refrigerant from the cooling system has been retrieved in apparatus 10, it may be reused after the repair or the retrieval apparatus can be taken to a refrigerant processing facility where the refrigerant is removed from the apparatus 10 and processed for reuse. The process of refrigerant recovery from apparatus 10 is expedited due to the tall cylindrical shape of housing 14 which can be tipped to a horizontal position causing the exposed surface area of the collected liquid refrigerant for heat exchange to be dramatically increased as compared with housing 14 in a vertical orientation. Apparatus 10 includes an access port 68 at the outlet 26 of tube 20 and an access port 70 at tube 30 for use in removing refrigerant from collecter tube 20 and housing 14.

A modified embodiment of the refrigerant retrieval and storage apparatus of the present invention as shown in FIGS. 4 through 8. Apparatus 80 includes a support stand 82, a cylindrical body 83 closed at its lower end by integrally formed bottom member 85 and closed at the upper end by manifold block 88 defining a housing 84. The outside of body 83 is covered by insulation 86. The manifold block 88 contains the necessary valves and connecting ports for operating the apparatus 80. The manifold block 88 is shown in greater detail in FIGS. 5-8.

Figure 5:
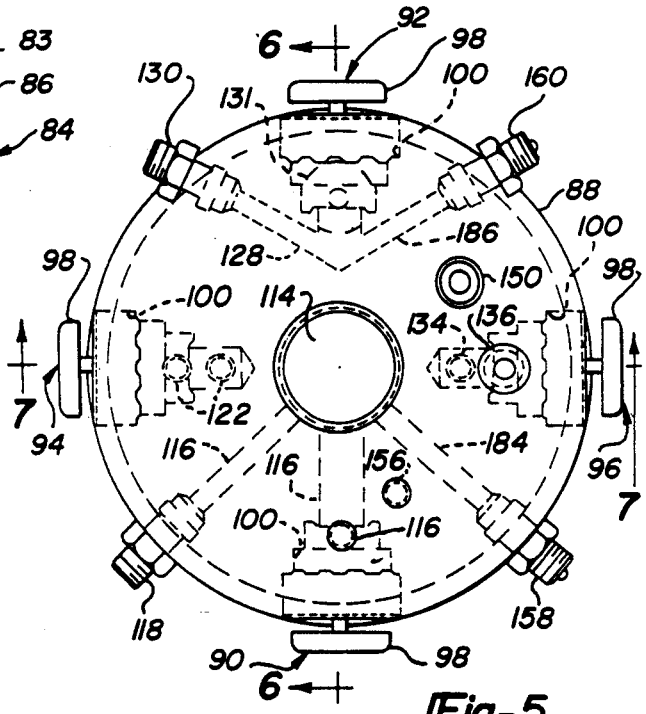
FIG. 5 is a top view of the apparatus shown in FIG. 4.

Manifold block 88 serves as a valve body for the high side valve 90, the low side valve 92, the metering valve 94 and a charge valve 96. Only the hand knobs 98 of each valve are shown in FIG. 5 along with the corresponding cavities 100 machined in the manifold block 88 for receiving the internal components of the valves. Valve 94 is shown in greater detail in FIG. 8 and is representative of the other valves 90, 92 and 96. Valve 94 includes a bonnet 102 threadably secured into the outer recess 104 of cavity 100. Bonnet 102 carries the valve stem 106 to which is supported in the hand knob 94 and the valve seat 108. When the valve is closed, the seat 108 is firmly positioned against the inner recess 110 of the cavity 100. When valve 94 is closed, flow through the metering passage 122 is prevented. Valves 90, 92, 94 and 96 are of standard construction commonly used in service equipment for heating and cooling systems.

The center of the manifold block 88 includes a sight glass consisting of a cavity 112 sealed at its upper end by a glass 114. The sight glass enables visual monitoring of the liquid refrigerant flow into and out of the retrieval and storage apparatus 80. A high side inlet passage 116 in the manifold block 88 extends from a flare fitting 118 through the sight glass to the high side valve 90 where it is connected to the entrance 117 of the heat exchanger tube 119 in the interior 124 of the housing 84. The exit 120 of the heat exchanger tube 119 leads to a metering passage 122 which passes through metering valve 94 and connects the exit of the heat exchanger tube to the interior 124 of housing 84 through the flash tube 126.

A low side suction passage 128 extends through the manifold block 88 from a flared fitting 130 through the low side valve 92 to opening 131 on the bottom of the manifold block, opening into the interior 124 of the housing 84. The low side valve 82 is operable to open and close the low side suction passage 128.

A liquid dip tube 132 extends from the bottom of housing 84 up to a charge passage 134 which passes through charge valve 96 leading to the flare fitting 136 on the top of manifold block 88.

A relief valve 150 on the top of manifold block 88 is coupled to relief passage 152 in manifold block 88 in communication with the interior 124 of the housing. Relief valve 150 is preset to open at approximately 400 to 450 psi to vent the interior of the housing in the event the pressures exceed that level to prevent damage to the apparatus. The relief pressure is five to ten times greater than the normal operating pressures that the apparatus 80 should experience.

A thermometer well 154 extends from the lower side of the manifold block 88 in communication with a through passage 156. The lower end of the well 154 is closed to prevent escape of refrigerant from the housing and enables an operator to insert a thermometer into the well 154 to monitor the internal temperature in the apparatus housing 84.

Figure 9:
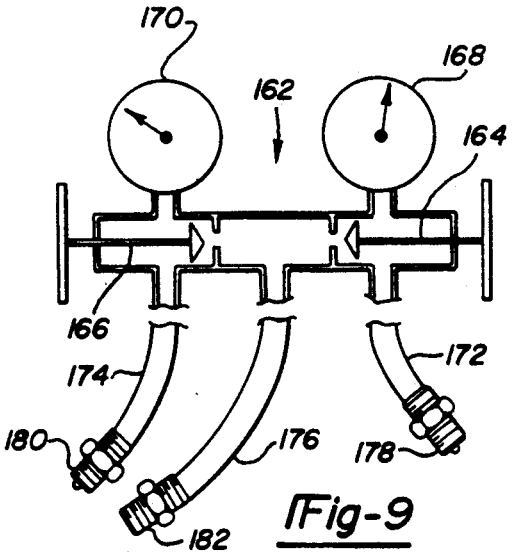
FIG. 9 is a schematic view of a gauge manifold used with the passive refrigerant retrieval and storage apparatus of FIG. 4.
Figure 6:
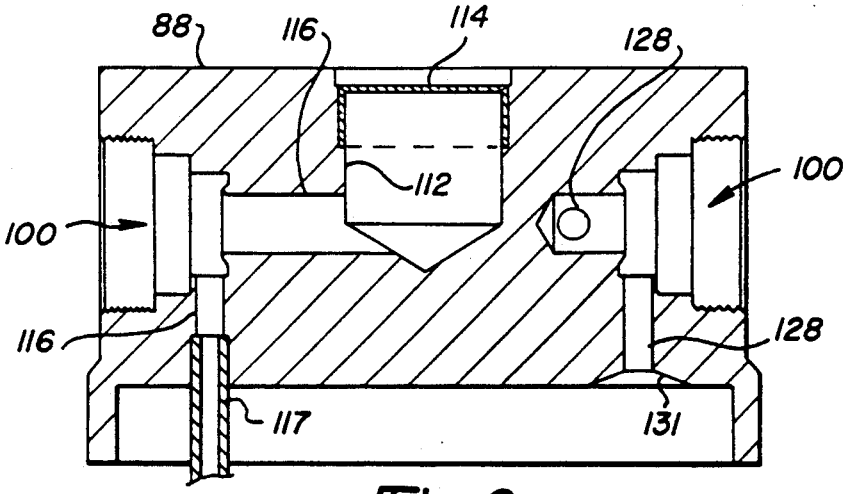
FIG. 6 is a sectional view as seen from substantially the line 6—6 of FIG. 5.
Figure 7:
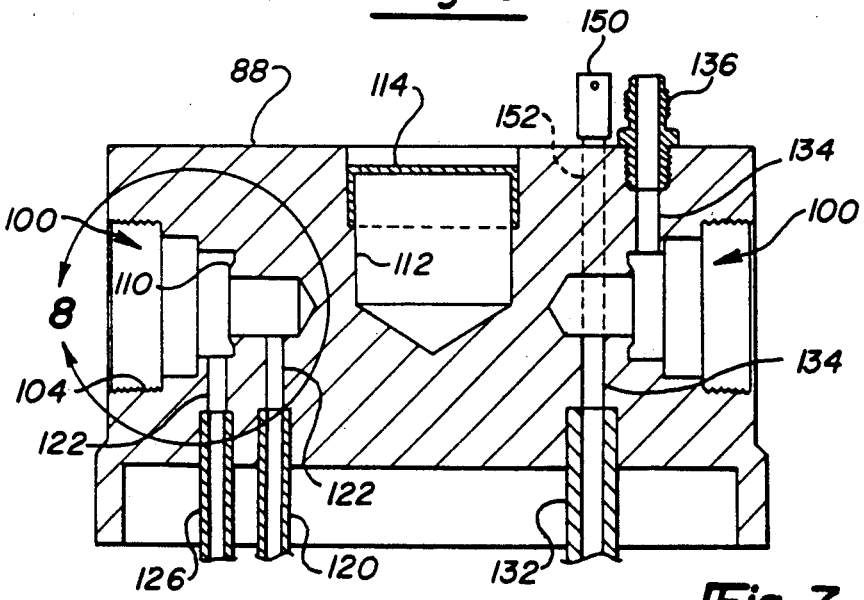
FIG. 7 is a sectional view as seen from substantially the line 7—7 of FIG. 5.
Figure 8:
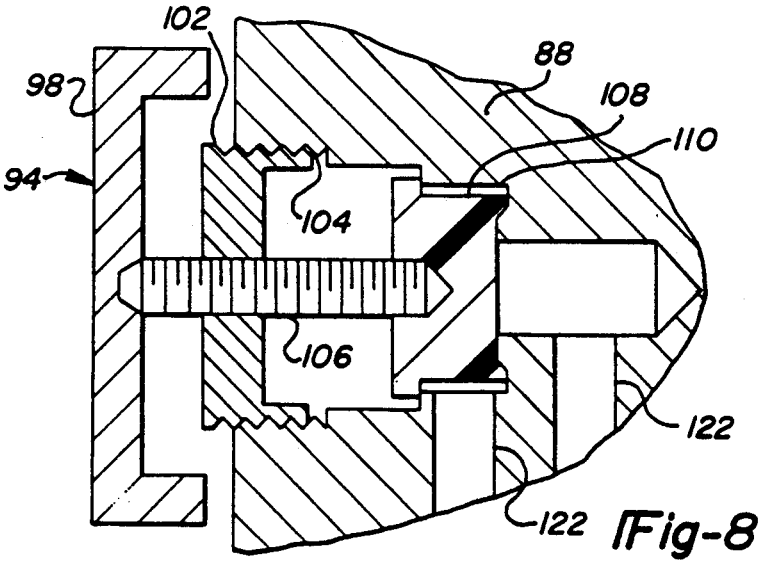
FIG. 8 is an enlarged view of the circled portion of FIG. 7.

Unlike retrieval and storage apparatus 10, apparatus 88 does not include pressure gauges as a part of the apparatus itself. Instead, the manifold block 88 is equipped with two schrader valve fittings 158 and 160 for connection to a standard gauge manifold 162 illustrated schematically in FIG. 9. Fittings 158 and 160 are in communication with the high side inlet passage 116 and the low side suction passage 128 respectively through high pressure gauge passage 184 and low pressure gauge passage 186 respectively. Gauge manifold 162 includes two valves 164 and 166, a high pressure gauge 168 and a low pressure gauge 170 along with three separate lengths of flexible hosing 172, 174 and 176.

The hoses 172, 174 and 176 can be equipped with fittings 178, 180 and 182 respectively that can be either schrader valve fittings or flare fittings, depending on what is necessary for attachment to the equipment being serviced. With a Schrader valve fitting 178 and hose 172, the high pressure gauge 168 can be connected to fitting 158 on the manifold 88 to monitor the pressure in the high side inlet passage 116. Likewise, with a schrader fitting 180 an hose 174, the low pressure gauge 170 can be connected to fitting 160 on the manifold block 80 to monitor the pressure in the low side suction passage 128. Use of the gauge manifold 162, with which a service technician would normally be equipped, eliminates the need for including gauges as a part of the refrigerant retrieval and storage apparatus.

Figure 3:
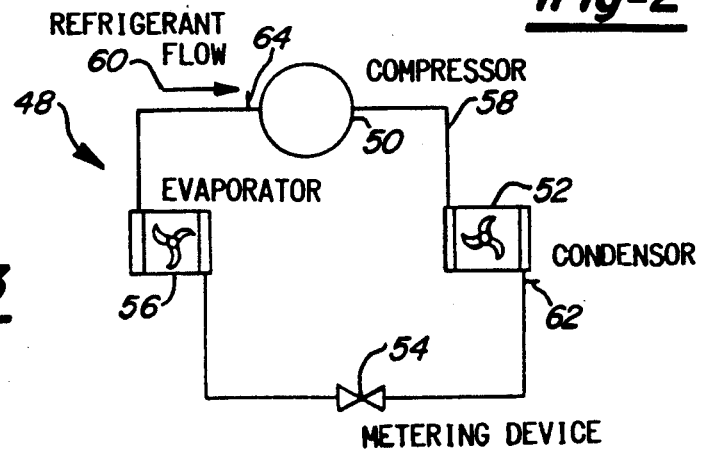
FIG. 3 is a schematic view of a typical cooling system.
Figure 4:
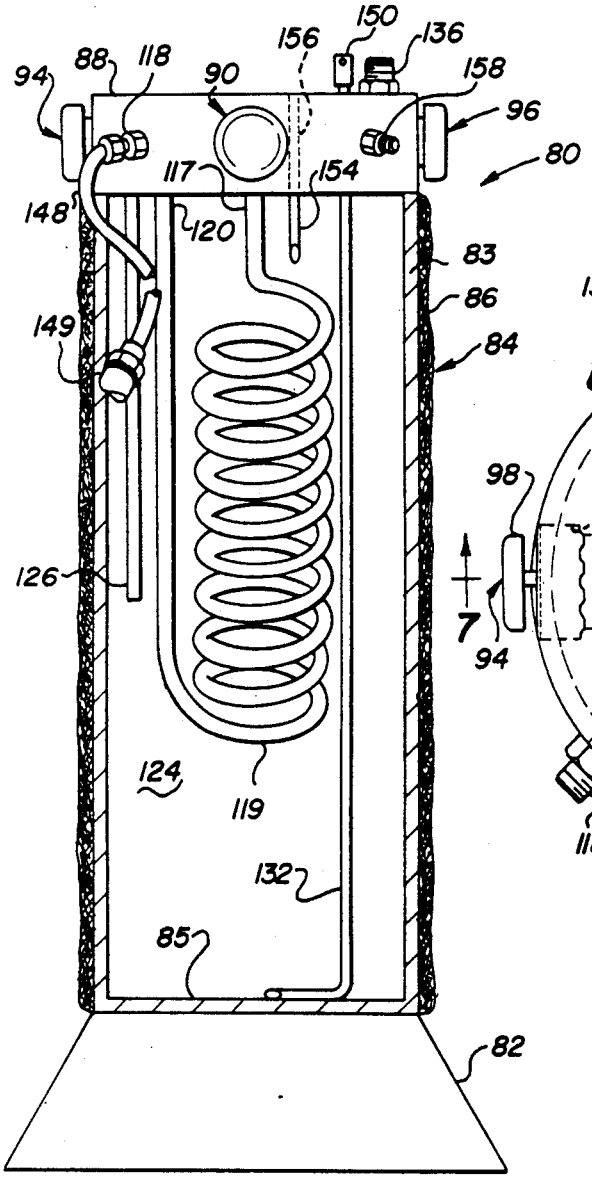
FIG. 4 is a side sectional view of an alternative embodiment of the passive refrigerant retrieval and storage apparatus of the present invention.

The refrigerant recovery and storage apparatus 80 is coupled to a cooling system to be serviced such as system 48 shown in FIG. 3, in a similar manner as the retrieval and storage apparatus 10 is connected to the cooling system. A flexible hose 148 connects the high pressure inlet passage 116 to the service fitting 62 of the cooling system immediately following the condenser while a second flexible hose (not shown) is used to connect the low side suction passage 128 with the service fitting 64 in the cooling system immediately proceeding the compressor inlet. With the cooling system operating and the high side valve 90 and low side valve 92 open and the metering valve 94 and charge valve 96 closed, the storage and retrieval apparatus functions as an evaporator installed parallel with the evaporator 56 of the cooling system. Liquid refrigerant from the condenser will collect in the heat exchanger tube 118. The flash valve 94 is opened slightly to enable a portion of the coolant to flow, through the metering passage 122 and flash tube 126 to the interior of housing 124 where the refrigerant flashes and cools the liquid refrigerant remaining in heat exchanger tube 118. The metering valve 94 is gradually opened as described previously regarding apparatus 10.

When the quantity of refrigerant leaving the housing 84 equals the quantity of refrigerant entering the collector tube, the low side valve 92 is closed, preventing refrigerant vapor in housing 84 from returning to the cooling system. The cooling system compressor continues to operate until the internal temperature of the apparatus reaches the saturation temperature at which no additional vaporized refrigerant will condense within the collector tube 119 or housing 84. When this occurs, the high side valve 90 is closed, effectively isolating their recovery device from the cooling system. At this point, 85–95% of the refrigerant has been recovered from the cooling system.

Additional refrigerant can be recovered by installing a piercing valve on the cooling system line leading from the compressor outlet and connecting the piercing valve to the fitting 136 on the top of the manifold block 88. The cooling system line downstream from and immediately adjacent to the piercing valve is pinched off such that all of the refrigerant leaving the compressor must travel to the retrieval and storage apparatus. With the charging valve 96 open, this vaporized refrigerant will travel through dip tube 132 and is discharged into the bottom of housing 84 where the vaporized refrigerant bubbles up through the liquid refrigerant trapped in the housing. This causes the vaporized refrigerant to cool and subsequently condense. Eventually, the cooling system compressor will pump all of the remaining refrigerant into the retrieval and storage apparatus pulling the cooling system into a vacuum. When this occurs, the charge valve 96 is closed and the retrieval process is complete.

The piercing valve is removed and the pierced hole and the pinch-off are repaired. Once the cooling system repair that necessitated the removal of the refrigerant has been completed, the cooling system is evacuated following standard procedures prior to recharging the system. The refrigerant contained in the retrieval and storage apparatus can be returned to the cooling system for reuse. This is accomplished by first connecting the center hose 176 of the gauge manifold to the flare fitting 136. With the low side valve 92 closed and the flash valve 94 closed, by opening the high side valve 90, the charge valve 96 and valve 164 of the gauge manifold, the pressure in the interior 124 of the housing and the vacuum created in the cooling system by the evacuation process will draw refrigerant into the cooling system. The liquid refrigerant travels from the housing interior 124, through dip tube 132, charging passage 134, gauge manifold valve 164 high pressure gauge passage 184, high side inlet passage 116 and finally through hose 148 into the cooling system.

Since the refrigerant flows from the apparatus 80 as a liquid, any contaminants and oil will also flow with the refrigerant from the apparatus, preventing contaminants from being left in the storage and retrieval apparatus 80. Furthermore, the flexible hose 148 used to connect the cooling system with the high side inlet passage 116 is equipped with a bi-flow filter 149 to filter the refrigerant both a it is being retrieved and as it is being returned to the cooling system.

After the liquid refrigerant has been drawn into the high side of the cooling system, additional refrigerant vapor is drawn into the cooling system low side. This is accomplished by disconnecting the hose 148 from the cooling system high side, operating the cooling system to allow the system pressures to stabilize and then opening both the high side and low side valves 164, 166 on the gauge manifold. With the charge valve closed, this will remove any liquid refrigerant remaining in the hose 148 by vaporizing the refrigerant and drawing it back through the gauge manifold into the cooling system low side. The pressure in the hose will eventually reach the cooling system low side pressure. The gauge manifold valve 164 is closed and the charging valve 96 opened. This connects the housing interior to the cooling system low side drawing any refrigerant from the housing until the pressure of the housing equals the cooling system low side pressure. At this point, refrigerant return is complete.

Apparatus 80 advantageously includes all of the valves and fittings within the housing manifold block 88. By including a charge valve 96 not included in the storage and retrieval apparatus 10, virtually all of the coolant can now be retrieved from the cooling system prior to performing the necessary service.

It is to be understood that the invention is not limited to the exact construction or method illustrated and described above, but that various changes and modifications may be made without departing from the spirit and scope of the invention as defined in the following claims.

I claim:

1. An apparatus for retrieval and storage of refrigerant from a cooling system having a low pressure side and a high pressure side, said apparatus comprising:

a housing formed in part by a manifold block, said housing defining an interior volume;

a collector vessel in heat exchange relationship with said housing;

first connecting means for connecting said collector vessel to the high pressure side of said cooling system to receive refrigerant from said cooling system, said first connecting means including a high side inlet passage through said manifold block;

second connecting means for connecting said collector vessel to the interior of said housing, said second connecting means including a metering passage through said manifold block;

a metering device disposed in said manifold block and there by establishing means for regulating refrigerant flow through said metering passage into the interior of said housing where a portion of the refrigerant vaporizes and cools refrigerant in said collector vessel; and third connecting means for connecting said housing interior to the low pressure side of said cooling system to return evaporated refrigerant from the housing interior to said cooling system, said third connecting means including a low side suction passage through said manifold block.

2. The apparatus of claim 1 further comprising high side valve means disposed in said manifold block selectively opening and closing said high side inlet passage and low side valve means disposed in said manifold block for selectively opening and closing said low side suction passage whereby said high side and low side valve means enable said apparatus to be isolated from said cooling system.

3. The apparatus of claim 1 further comprising high side port means in said manifold block in communication with said high side inlet passage for connecting with a gauge manifold to monitor the pressure in said high side inlet passage and low side port means in said manifold block communicating with said low side suction passage for connection with a gauge manifold to monitor the pressure in said low side suction passage.

4. The apparatus of claim 1 further comprising means forming a sight glass in said high side inlet passage whereby flow of refrigerant in said high side inlet passage can be visually monitored.

5. The apparatus of claim 1 wherein said metering device is adjustable.

6. The apparatus of claim 1 further comprising pressure relief valve means mounted to said manifold block for relieving pressure in said housing interior above a predetermined value.

7. The apparatus of claim 1 further comprising means forming a thermometer well in said manifold block for reception of a thermometer to monitor the temperature in said housing interior.

8. The apparatus of claim 1 further comprising at least one flexible hose for connecting said apparatus to the cooling system.

9. The apparatus of claim further comprising fourth connection means for connecting said housing interior directly to the high pressure side of said cooling system, said fourth connecting means including a charge passage through said manifold block.

10. The apparatus of claim 9 further comprising valve means disposed in said manifold block for selectively opening and closing said charge passage.

11. The apparatus of claim 10 further comprising a dip tube disposed in said housing interior extending from said charge passage to a lowermost location in said housing interior.

12. An apparatus for retrieval and storage of refrigerant from a cooling system having a low pressure side and a high pressure side, said apparatus comprising:

a collector vessel;

first connecting means for connecting said collector vessel to the high pressure side of said cooling system to receive refrigerant from the cooling system;

a housing in heat exchange relationship with said collector vessel;

second connecting means including a metering device for connecting said collector vessel to the interior of said housing and there by establishing means whereby refrigerant can be discharged from said collector vessel through said metering device into the interior of said housing where a portion of the refrigerant vaporizes and cools refrigerant in said collector vessel;

third connecting means for connecting said housing interior to the low pressure side of said cooling system to return evaporated refrigerant to said cooling system; and fourth connecting means for connecting the high pressure side of said cooling system directly to the interior of said housing to receive refrigerant from said cooling system.

13. The apparatus of claim 12 further comprising:

a high side valve in said first connecting means for selectively connecting and disconnecting said collector vessel from the high pressure side of the cooling system;

a low side valve in said third connecting means for selectively connecting and disconnecting said housing interior from the low pressure side of the cooling system; and a charge valve in said fourth connecting means for selectively connecting and disconnecting the high pressure side of the cooling system directly to the interior of the housing whereby said apparatus can be isolated from said cooling system.

14. The apparatus of claim 12 wherein said collector vessel is a cooled tube disposed within said housing interior.

15. The apparatus of claim 12 further comprising:

high side gauge port means for coupling with a pressure gauge to monitor the pressure in said collector vessel; and low side gauge port means for coupling with a pressure gauge to monitor the pressure in said housing interior.

16. The apparatus of claim 12 wherein said metering device is adjustable.

17. The apparatus of claim 13 wherein:

said housing is formed in part by a manifold block;

said first connecting means includes a high side inlet passage in said manifold block and said high side valve opens and closes said high side inlet passage;

said second connecting means includes a metering passage in said manifold block and said metering device is disposed in said metering passage;

said third connecting means includes a low side suction passage in said manifold block and said low side valve opens and closes said low side suction passage; and said fourth connecting means includes a charge passage in said manifold block and said charge valve opens and closes said charge passage.

* * * * *

UNITED STATES PATENT AND TRADEMARK OFFICE

CERTIFICATE OF CORRECTION

PATENT NO. : 5,088,291

DATED : February 18, 1992

INVENTOR(S) : David C. Squires

It is certified that error appears in the above-identified patent and that said Letters Patent is hereby corrected as shown below:

Column 1, Line 8, "Oct. 10, 1990" should read --Oct. 5, 1990--.

Column 8, Line 50, Claim 1, "there by" should read --thereby--.

Column 9, Line 26, Claim 9, after "claim" add --1--.

Column 9, Line 50, Claim 12, "there by" should read --thereby--.

Signed and Sealed this

Thirtieth Day of August, 1994

*Attest:*

*Attesting Officer*

Bruce Lehman

BRUCE LEHMAN

*Commissioner of Patents and Trademarks*